United States Patent [19]

Schaper et al.

[11] Patent Number: 4,929,315

[45] Date of Patent: May 29, 1990

[54] METHOD FOR ELECTROPLATING A CONDUCTING SURFACE

[75] Inventors: Siegfried Schaper, Wettstetten; Martin Seufert, Kipfenberg, both of Fed. Rep. of Germany

[73] Assignee: Audi AG, Ingolstadt, Fed. Rep. of Germany

[21] Appl. No.: 328,033

[22] PCT Filed: Aug. 7, 1987

[86] PCT No.: PCT/EP87/00433

§ 371 Date: Feb. 9, 1989

§ 102(e) Date: Feb. 9, 1989

[87] PCT Pub. No.: WO88/03183

PCT Pub. Date: May 5, 1988

[30] Foreign Application Priority Data

Oct. 31, 1986 [DE] Fed. Rep. of Germany ..... 3637088

[51] Int. Cl.[5] ..... C25D 5/02

[52] U.S. Cl. ..... 204/18.1

[58] Field of Search ..... 204/15, 18.1

[56] References Cited

FOREIGN PATENT DOCUMENTS 2013590A 1/1979 United Kingdom .

*Primary Examiner*—T. M. Tufariello

*Attorney, Agent, or Firm*—Lalos & Keegan

[57] ABSTRACT

A process for galvanic coating of a selected area on a preform, comprising applying an electrically conducting metallic primer to substantially the entire surface of the preform; masking a portion of the surface coated leaving exposed an unmasked portion not to be coated; forming a clear coat to the exposed portion not to be galvanized; removing the mask to expose the portion of the surface not clear coated; and galvanically coating the area of metallic primer.

11 Claims, 1 Drawing Sheet

METHOD FOR ELECTROPLATING A CONDUCTING SURFACE

BACKGROUND OF THE INVENTION

The invention described herein relates to a process for galvanic coating (electroplating) of at least one selected area on a conducting surface, in particular a surface of plastic moldings.

Electroplating processes are known from, for example, DE-OS 2,648,274 which relates to applying galvanic patterns of metal onto metal or other substrates. In order to obtain the desired pattern or to confine the galvanizing electrolyte to specific areas of the substrate, the substrate is masked. The individual steps of such a masking process have repeatedly been a cause of problems to the present state of the art and have significantly increased process costs. While prior art relates to the production of integrated circuits and is particularly concerned with holding losses of noble metals to a minimum, the process in the automotive industry has been to use black masking paints which are applied to the areas not to be galvanized and are then coated with a metallic finish. In the conventional procedure, for example for partially chrome plated hub caps with a silver metal finish, the black masking paint is first applied to the areas not to be chrome plated. This was then followed by the customary galvanization. The chrome plated areas were subsequently covered (by adhesive or masking tape) and then finally the black areas coated by the first masking paint were painted with a metallic finish.

The prior art procedures described are, however, time consuming and costly, particularly with respect to operations and materials.

It is thus the object of the present invention to improve the process described at the outset to such an extent that the shortcomings described are reliably avoided and the operations are as economical in materials and time as possible The invention that overcomes these problems includes use of an electrolytic current, in which masking is carried out in order to apply selectively galvanic coating to at least this one area of the conducting surface. An electrically conducting metallic primer is first applied to the whole of the surface of the molding. The area(s) to be galvanically coated are then masked, while a clear coat such as a clear varnish is applied to the area not to be galvanically coated. Following mask removal, the areas of the metallic primer are galvanically coated directly.

The process according to the invention makes use of the fact that the metallic finish consists of two layers, viz. the electrically conducting metallic primer or base varnish and the non-conducting clear coat or clear varnish. After the metallic primer and the clear coat have been applied with appropriate masking, the area of the electrically conducting metallic primer can, after removal of the maskings, be galvanically coated directly, thus making the use of a black masking paint which must yet again be recoated, superfluous. This economizes not only in masking and painting operations, but also in materials which would otherwise have to be used for the black masking paint.

The above has been a brief description of the prior art and the advantages of the invention. A preferred procedural example is explained in greater detail in the diagrams below and other advantages may be perceived by those skilled in the art.

DETAILED DESCRIPTION OF THE PREFERRED EMBODIMENT

Figure 1:
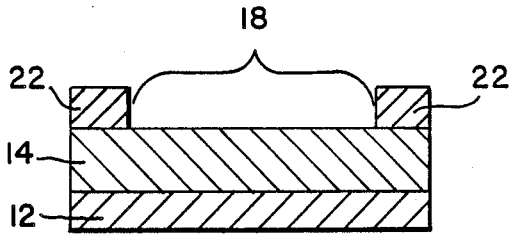
FIG. 1 is a cross-section through an assembly of layers during the process according to the invention.

In FIG. 1, the molding serving as a substrate is generally designated as 12. The process according to the invention is not confined to any particular moldings. On the contrary, they can be freely chosen in respect of type, shape and size. However, the use of the process according to the invention is especially targeted to the automotive industry, preferably to provide hub caps with a silver metallic finish, the said hub caps being subsequently selectively chrome plated.

Figure 2:
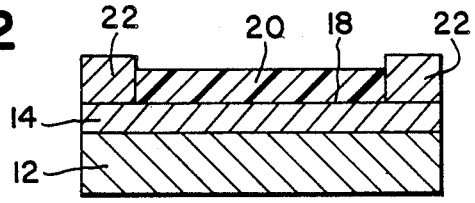
FIG. 2 is a further cross-section of the assembly of layers at a different point in time of the process according to the invention.
Figure 3:
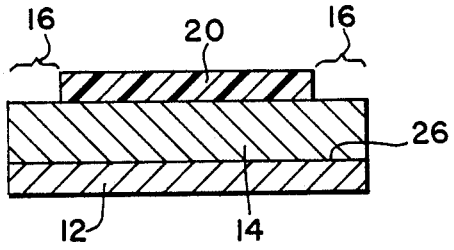
FIG. 3 is a cross-section through an assembly of layers after mask removal.
Figure 4:
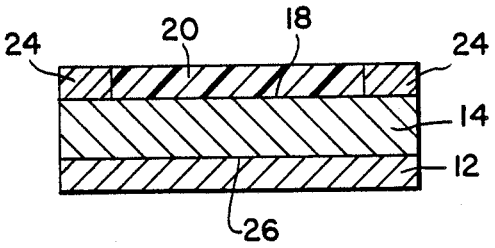
FIG. 4 is a cross-section through an assembly of layers after completion of the process according to the invention.

The whole of the surface 26 of the substrate or molding 12 first receives the metallic primer 14. The edge areas 22, for example, are then masked. It is understood that the format and the number of the maskings may be freely chosen. The area (18) not to be galvanically coated then receives the clear varnish 20, with the result that the assembly of layers shown in FIG. 2 is formed The maskings from the edge area are then removed with the result that the areas to be galvanically coated 16, shown in FIG. 3, are set free or exposed. Finally, conventional galvanizing is effected in such a way that the assembly of layers shown in FIG. 4 having galvanized edge areas 24 are formed.

In another embodiment of the process, it is also conceivable that organic or inorganic particles, for example metallic flakes such as bronze flakes, are removed from the primer by means of an etchant prior to the final galvanization.

What is claimed is:

1. A process for galvanic coating of at least a selected area on a preform comprising, (a) applying an electrically conducting metallic primer to substantially the entire surface of the preform;

(b) masking a portion of the surface coated leaving exposed an unmasked portion not to be coated;

(c) forming a clear coat to the exposed portion not to be galvanized;

(d) removing the mask to expose the portion of the surface not clear coated; and (e) galvanically coating the area of metallic primer.

2. The process according to claim 1, wherein said metallic primer includes organic or inorganic particles and said forming step includes removing said particles from said primer by means of an etchant.

3. The process according to claim 1 or 2, wherein said step of applying a metallic primer includes applying a silver metallic finish.

4. The process according to claim 1 or 2 wherein said preform is a plastic mold of a hub cap.

5. A galvanized article comprising:

(a) a first layer comprising a preform having plastic molding;

(b) a second layer of electrically conducting metallic primer;

(c) a third layer having at least two materials, a first material being a clear coat and a second material being metal galvanically coated directly to said metallic primer.

6. The galvanized article according to claim 5 wherein said plastic molding is a hub cap.

7. The galvanized article according to claim 5 wherein said metal primer includes a silver metallic finish.

8. The galvanized article according to claim 5 wherein said metal galvanically coated on said primer is chrome.

9. The galvanized article according to claim 5 wherein said clear coat is a clear varnish and said primer is a metallic varnish.

10. A hub cap for an automobile comprising:

(a) a plastic molding substrate in the form of a hub cap;

(b) a layer of silver metallic varnish substantially completely covering said substrate;

(c) a clear varnish covering a portion of said layer; and (d) chrome galvanically coated directly on a portion of said layer not covered by said clear varnish.

11. The process according to claim 1 or 2 wherein said galvanically coating step includes chrome plating to the exposed areas of metallic primer.

* * * * *